US010571131B2

(12) United States Patent
Paller

(10) Patent No.: US 10,571,131 B2
(45) Date of Patent: Feb. 25, 2020

(54) OVEN APPLIANCE HAVING A CONVECTION ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 569 days.

(21) Appl. No.: 15/366,074

(22) Filed: Dec. 1, 2016

(65) Prior Publication Data

US 2018/0156469 A1 Jun. 7, 2018

(51) Int. Cl.
*F24C 3/00* (2006.01)
*F24C 15/32* (2006.01)

(52) U.S. Cl.
CPC ..... *F24C 3/004* (2013.01); *F24C 15/322* (2013.01)

(58) Field of Classification Search
CPC ..... F24C 15/322; A21B 1/26
See application file for complete search history.

(56) References Cited

U.S. PATENT DOCUMENTS 4,108,139 A * 8/1978 Gilliom ..... F24C 15/006 126/21 A
4,802,459 A 2/1989 McFadden et al.
4,951,645 A * 8/1990 Luebke ..... A21B 1/245 126/19 R
5,080,087 A * 1/1992 McFadden ..... F24C 3/087 126/20
5,454,295 A * 10/1995 Cox ..... A21B 1/245 126/21 A
5,497,760 A * 3/1996 Alden ..... F24C 15/322 126/21 A
5,601,070 A * 2/1997 Hotard ..... F24C 15/322 126/21 A
5,676,044 A * 10/1997 Lara, Jr. ..... A21B 1/245 126/21 A
6,060,701 A * 5/2000 McKee ..... F24C 15/322 126/21 A
6,376,817 B1 * 4/2002 McFadden ..... A21B 1/245 126/21 A
6,718,965 B2 4/2004 Rummel et al.
8,294,070 B2 * 10/2012 McNamee ..... A21B 1/245 219/679

(Continued)

*Primary Examiner* — Avinash A Savani
*Assistant Examiner* — Deepak A Deean
(74) *Attorney, Agent, or Firm* — Dority & Manning, P.A.

(57) ABSTRACT

An oven appliance is provided herein. The oven appliance may include a cabinet, a convection duct, a heating element, and an air handler. The cabinet may define a cooking chamber to receive items to be cooked. The cabinet may include a top wall, a bottom wall, a rear wall, and opposing sidewalls. The top wall and the bottom wall being spaced apart along a vertical direction. The opposing sidewalls may be spaced apart along a lateral direction. The convection duct may extend about a portion of the cooking chamber to direct a heated gas. The convection duct may define an upper passage above the top wall and a lower passage below the bottom wall. The heating element may be disposed within the convection duct to supply the heated gas thereto. The air handler may be disposed in fluid communication with the convection duct to motivate the heated gas therethrough.

12 Claims, 6 Drawing Sheets

(56) References Cited

U.S. PATENT DOCUMENTS

| | | | | |
|---|---|---|---|---|
| 2003/0140917 | A1* | 7/2003 | Rummel | F24C 15/322 126/21 A |
| 2008/0105249 | A1* | 5/2008 | McFadden | A21B 1/245 126/21 A |
| 2014/0174426 | A1* | 6/2014 | Moon | F24C 15/322 126/21 A |
| 2016/0025355 | A1* | 1/2016 | Armstrong | F24C 15/325 219/400 |

* cited by examiner

OVEN APPLIANCE HAVING A CONVECTION ASSEMBLY

FIELD OF THE INVENTION

The present subject matter relates generally to oven appliances, and more particularly to oven appliances having a convection heating assembly.

BACKGROUND OF THE INVENTION

Conventional residential and commercial oven appliances generally include a cabinet that defines a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber.

Some conventional appliances include a convection heating assembly, which may include a convection heating element and fan or other mechanism for creating a flow of heated air within the cooking chamber. During use, the burners or electric heating elements may be separately activated to direct or radiate heat to, for instance, a food item being cooked. For instance, during broiling operations, the heating elements of the broiler heating assembly may be activated to heat a predefined radiant surface to an elevated temperature so that heat may be radiated above a food item. During baking operations, the heating elements of the baking heating assembly may be activated to provide heat directly below a food item within the cooking chamber. Generally, the broiler heating assembly is deactivated during baking operations and the baking heating assembly is deactivated during broil operations.

Oftentimes, these conventional appliances are unable to quickly transition from baking to broiling, and vice versa. Additional time must be allowed to pass in order to one heating assembly to reach a suitable cooking temperature and for the other heating assembly to drop to a suitable non-cooking temperature. For example, in the case of radiant heating elements, significant amount of pre-heating time before a suitable temperature is reached. This additional pre-heating time may frustrate a user and/or hinder certain cooking operations.

Moreover, the heating elements of conventional appliances may occupy a set amount of space within the cooking chamber. For instance, one or more elements may extend downward into the defined cooking chamber. One or more other elements may extend upward into the defined cooking chamber. These configurations may thereby reduce the usable volume of the cooking chamber, limiting the size of items that may be positioned or cooked therein.

Accordingly, oven appliances having an improved convection assembly would be desirable. Specifically, oven appliances having a convection assembly that could quickly transition between multiple cooking operations. Additionally, it may be desirable for broiler assemblies to quickly reach an instructed temperature. It may be further desirable for broiler assemblies to reduce the amount of cooking chamber volume otherwise dedicated to heating elements.

BRIEF DESCRIPTION OF THE INVENTION

Aspects and advantages of the invention will be set forth in part in the following description, or may be obvious from the description, or may be learned through practice of the invention.

In one aspect of the present disclosure, an oven appliance is provided. The oven appliance may include a cabinet, a convection duct, a heating element, and an air handler. The cabinet may define a cooking chamber to receive items to be cooked. The cabinet may include a top wall, a bottom wall, a rear wall, and opposing sidewalls. The top wall and the bottom wall being spaced apart along a vertical direction. The opposing sidewalls may be spaced apart along a lateral direction. The convection duct may extend about a portion of the cooking chamber to direct a heated gas. The convection duct may define an upper passage above the top wall and a lower passage below the bottom wall. The heating element may be disposed within the convection duct to supply the heated gas thereto. The air handler may be disposed in fluid communication with the convection duct to motivate the heated gas therethrough.

In another aspect of the present disclosure, an oven appliance is provided. The oven appliance may include a cabinet, a convection duct, a broiler plate, a bake plate, a heating element, and an air handler. The convection duct may extend about a portion of the cooking chamber to direct a heated gas. The convection duct may define an upper passage above the top wall and a lower passage below the bottom wall. The broiler plate may be positioned at a top portion of the cooking chamber. The broiler plate may define a plurality of apertures in fluid communication with the upper passage. The bake plate may be positioned at a bottom portion of the cooking chamber. The bake plate may define a plurality of apertures in fluid communication with the lower passage. The heating element may be disposed outside of the cooking chamber within the convection duct to alternately supply the heated gas to the upper passage and the lower passage. The air handler may be disposed within the convection duct to motivate the heated gas therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
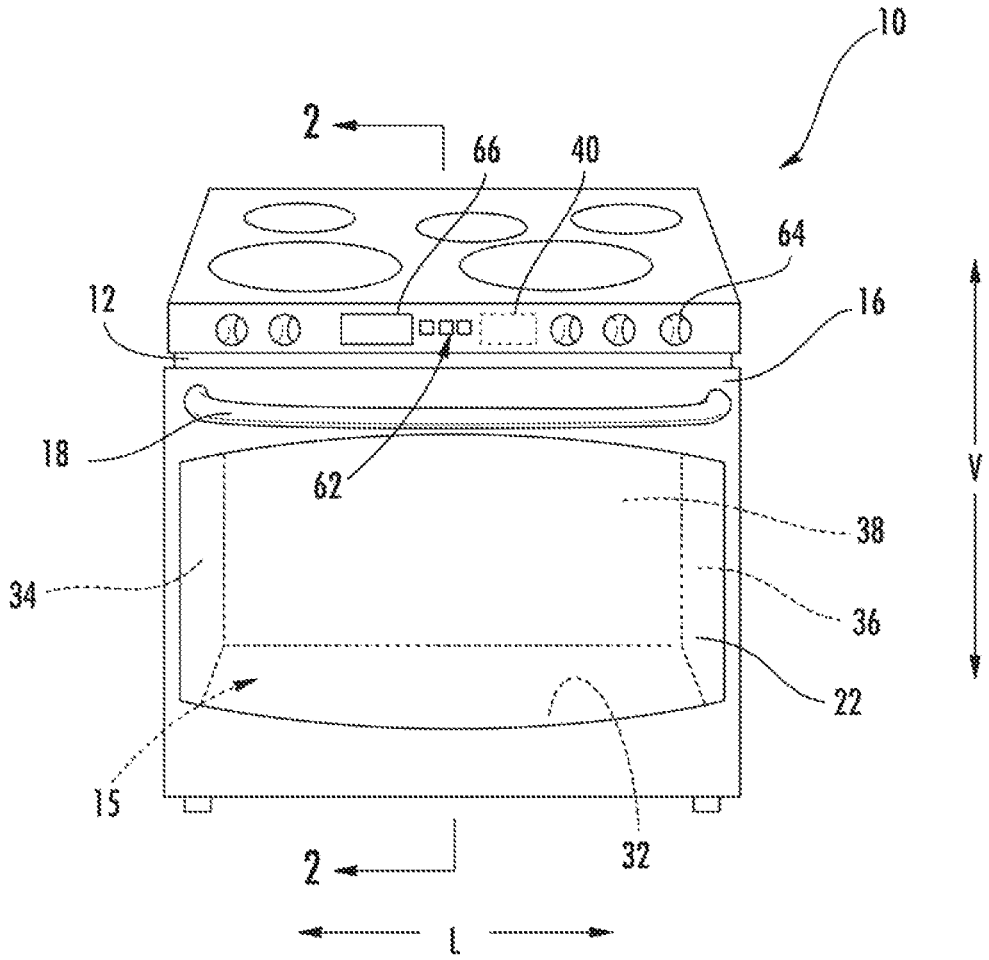
FIG. 1 provides a front perspective view of an oven appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, some aspects of the present disclosure provide an oven appliance that includes a convection assembly for cooking or heating food items placed within a cooking chamber of the oven appliance. The convection assembly can include a heating element that is kept outside of the cooking chamber. However, heat generated by the heating element can be blown to the cooking chamber by an air handler. For instance, heat may be selectively directed to a top portion of the appliance or a bottom portion of the appliance, depending on a desired cooking operation.

Figure 2:
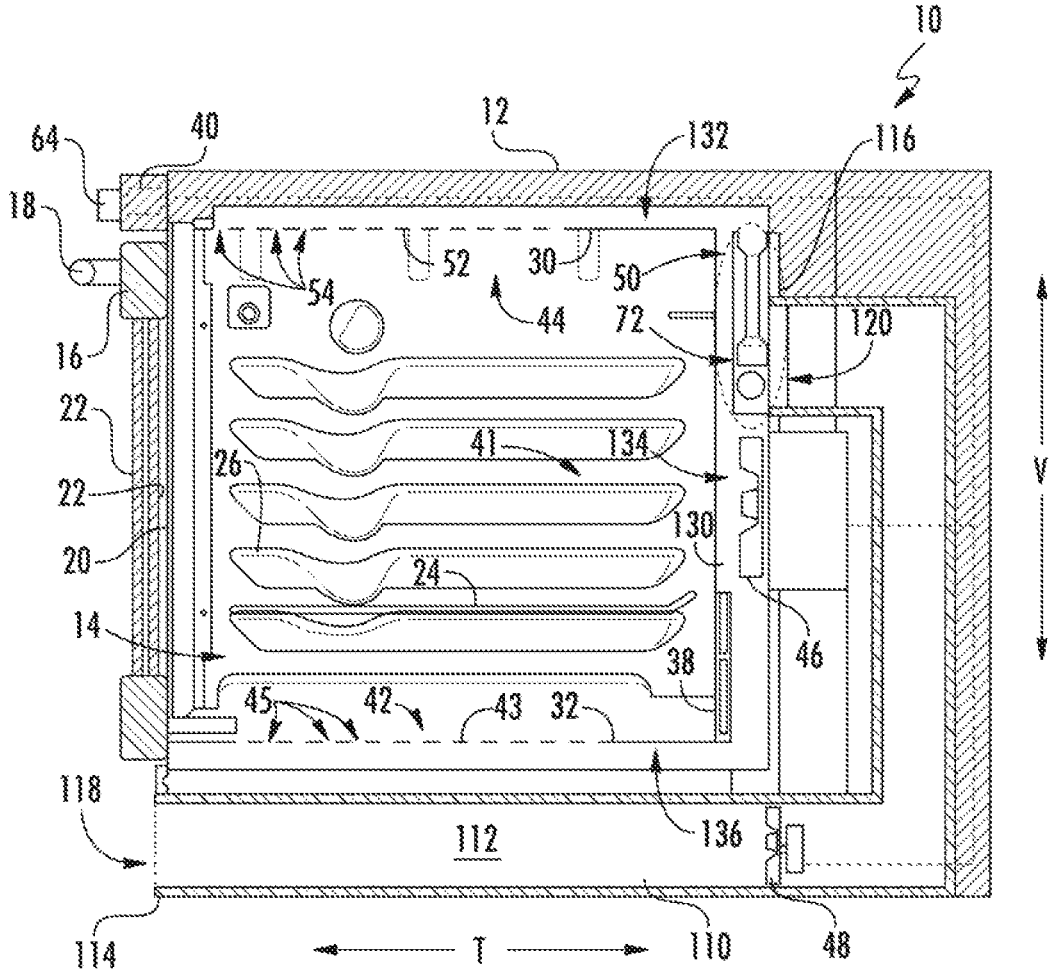
FIG. 2 provides a sectional view of the example oven appliance of FIG. 1 taken along the line 2-2 of FIG. 1.
Figure 3:
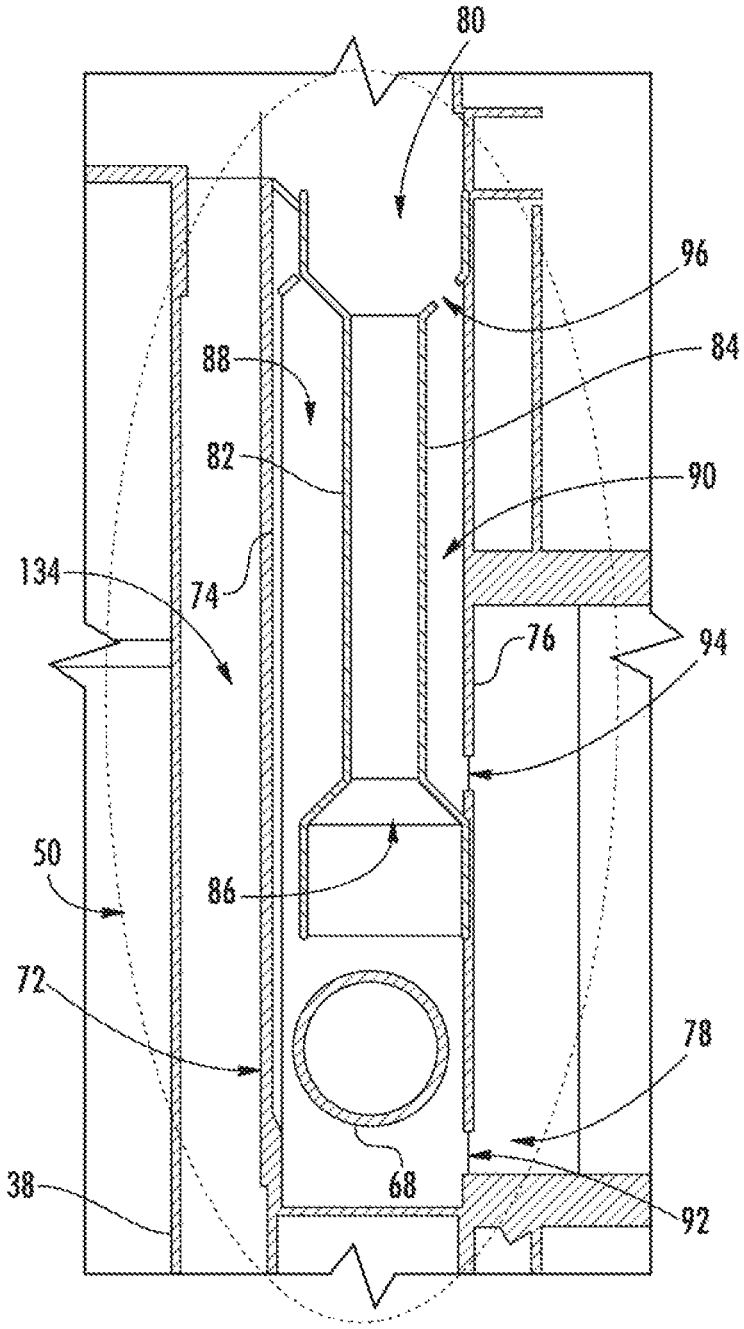
FIG. 3 provides a magnified sectional view of a heating element of the example oven appliance of FIG. 2.

Turning now to the figures, FIGS. 1 through 3 provide several views of example embodiments of the present subject matter. For instance, FIG. 1 provides a perspective view of an oven appliance 10 according to example embodiments of the present subject matter. FIG. 2 provides a section view of oven appliance 10 taken along the 2-2 line of FIG. 1. FIG. 3 provides a magnified sectional view of a heating element of the example oven appliance of FIG. 2. Oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable oven appliance. Thus, the present subject matter may be used with other oven or range appliance configurations, e.g., that define multiple interior cavities for the receipt of food and/or having different configuration than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access opening 20 to cooking chamber 14. For example, a user can pull on handle 18 to open or close door 16 and access cooking chamber 14 through opening 20.

Oven appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various sidewalls define the cooking chamber 14. For example, cooking chamber 14 includes a top wall 30 and a bottom wall 32 which are spaced apart along the vertical direction V. Left sidewall 34 and right sidewall 36 (as defined according to a front view as shown in FIG. 1) extend between the top wall 30 and bottom wall 32, and are spaced apart along the lateral direction L. A rear wall 38 additionally extends between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

A convection heating assembly 41 is provided in oven appliance 10. Convection heating assembly 41 may include one or more air handlers 46, 48, e.g., fans or blowers, and a heating element 50. Heating element 50 may be an electric heating element, such as a resistive heating rod (not pictured), or a gas burner configured to generate a heated gas for cooking operations. As shown, heating element 40 is disposed outside of cooking chamber 14, e.g., within a separate duct, as will be described below. Optionally, heating element 50 may be the solitary or exclusive heating element for the cooking chamber 14.

As illustrated, convection heating assembly 41 includes a convection heating duct 130. Convection duct 130 is provided in general fluid communication with cooking chamber 14. Convection duct 130 may extend along a portion of the cooking chamber 14, e.g., outside of cooking chamber 14, to direct a heated gas therethrough. For instance, convection duct 130 may extend from heating element 50 to broiler plate 52. Convection duct may further 130 extend from heating element 50 to bake plate 43.

In certain embodiments, an upper passage, e.g., a broiler passage 132, is defined by convection duct 130. Broiler passage 132 may be defined above top wall 30 along the vertical direction V. Moreover, broiler passage 132 may be defined perpendicular to the vertical direction V. When assembled, broiler passage 132 is in fluid communication between heating element 50 and broiler plate 52. In some such embodiments, broiler passage 132 extends along top wall 30 of cooking chamber 14, as shown in FIG. 2, e.g., from an outlet 80 of burner enclosure 72.

In additional or alternative embodiments, a lower passage, e.g., a bake passage 136, is defined by convection duct 130. Bake passage 136 may be defined below bottom wall 32 along the vertical direction V. Moreover, bake passage 136 may be defined perpendicular to the vertical direction V. When assembled, bake passage 136 is in fluid communication between heating element and broiler plate 52. In some such embodiments, bake passage 136 extends along bottom wall 32 of cooking chamber, as shown in FIG. 2.

In still further additional or alternative embodiments, an intermediate passage, e.g., a circulation passage 134, is defined by convection duct 130. Specifically, circulation passage 134 may be defined in fluid communication between a bottom portion of cooking chamber 14 and a top portion of cooking chamber 14, e.g., through broiler passage 132 and/or bake passage 136. In certain embodiments, circulation passage 134 extends along the vertical direction V, e.g., perpendicular to the transverse direction T. At least a portion of circulation passage 134 may be defined by rear wall 38, as shown in FIG. 2. e.g., between rear wall 38 and an outer wall 74 of burner enclosure 72. Moreover, as shown, circulation passage 134 may be defined alongside burner enclosure 72 below outlet 80.

In some embodiments, a lower heating assembly, such as a baking assembly 42, is included in oven appliance 10, e.g., for baking operations within cooking chamber 42. Baking assembly 42 may include bake plate 43 defining a plurality of apertures 45. Bake plate 43 may be in fluid communication with air handler(s) 46, 48 and/or heating element 50, e.g., through convection duct 130. Specifically, the apertures 45 of bake plate 43 are in fluid communication with bake passage 136. As illustrated, bake plate 43 is generally positioned away from heating element 50 such that convection heat (and not radiation heat) is received from heating element 50. Air handler(s) 46, 48 may be in fluid communication with heating element 50 and bake plate 43 to motivate heated gas from the heating element 50 and through the apertures 45 of the bake plate 43. As will be described in detail below, bake plate 43 may be provided along a portion of the cooking chamber 14. Moreover, during certain operations, bake plate 43 may be downstream from air handler(s) 46, 48 and heating element 50 to receive a heated gas therefrom.

An upper heating assembly, such as a broiler assembly 44, may be included in oven appliance 10. A broiler plate 52 defining a plurality of apertures 54 may be in fluid communication with air handler(s) 46, 48 and/or heating element 50, e.g., through convection duct 130. Specifically, the apertures 54 of broiler plate 52 are in fluid communication with broiler passage 132. As illustrated, broiler plate 52 is generally positioned away from heating element 50 such that convection heat (and not radiation heat) is received from heating element 50. Heating element 50 may be an electric heating element, such as a resistive heating rod (not pictured), or a gas burner configured to generate a heated gas for cooking operations. Air handler(s) 46, 48 may be in fluid communication with heating element 50 and the broiler plate 52 to motivate heated gas from the heating element 50 and through the apertures 54 of broiler plate 52. As will be described in detail below, broiler plate 52 may be provided along a portion of the cooking chamber 14. Moreover, during certain operations, broiler plate 52 may be downstream from air handler(s) 46, 48 and heating element 50 to receive a heated gas therefrom.

Oven appliance 10 may further include a controller 40, e.g., configured to control one or more operations of the oven appliance 10. For example, controller 40 may control at least one operation of oven appliance 10 that includes heating element 50 (and convection heating assembly 41 generally). Controller 40 may be in communication (via for example a suitable wired or wireless connection) with the heating element 50 and other suitable components of the oven appliance 10, as discussed herein. In general, controller 40 may be operable to configure the oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface panel 62 of oven appliance 10 as shown in FIGS. 1 through 3. In some such embodiments, input/output ("I/O") signals may be routed between controller 40 and various operational components of oven appliance 10, such as heating element 50, air handler(s) 46, 48, controls 64, display component 66, sensors, alarms, and/or other components as may be provided. For instance, signals may be directed along one or more wiring harnesses that may be routed through cabinet 12. In some embodiments, controller 40 is in communication with user interface panel 62 and controls 64 through which a user may select various operational features and modes and monitor progress of oven appliance 10. In one embodiment, user interface panel 62 may represent a general purpose I/O ("GPIO") device or functional block. In one embodiment, user interface panel 62 may include input components, such as one or more of a variety of electrical, mechanical or electro-mechanical input devices including rotary dials, push buttons, and touch pads. User interface panel 62 may include a display component 66, such as a digital or analog display configured to provide operational feedback to a user.

As noted above, certain embodiments of heating element 50 are provided as a gas burner. In some such embodiments, heating element 50 includes a burner tube 68. Burner tube 68 is generally positioned away from broiler plate 52 and/or bake plate 43. For instance, burner tube 68 may be positioned such that a flame output by burner tube 68 is isolated and apart from broiler plate 52 and bake plate 43, e.g., thereby preventing the flame from contacting broiler plate 52 or bake plate 43. A fuel line 70 (FIG. 4) may be connected in fluid communication with burner tube 68 to selectively direct a fuel (e.g., natural gas) to burner tube 68. One or more igniters (not pictured) may be provided adjacent to burner tube 68 for igniting fuel. During operation, a flame can thus be generated at burner tube 68 after fuel is received at burner tube 68.

In some embodiments, a burner enclosure 72 contains at least a portion of heating element 50. For instance, burner enclosure 72 may include a plurality of outer walls 74, 76 housing burner tube 68. Outer walls 74, 76 may be substantially solid, non-permeable members to partially isolate burner tube 68. During use, a flame generated at the burner tube 68 is at least partially contained by burner enclosure 72, e.g., apart from broiler plate 52 and bake plate 43. Specifically, the flame is at least partially enclosed by outer walls 74, 76. An inlet 78 is defined through one or more of outer walls. For instance, inlet 78 may be defined through outer wall 76 and extend away from convection duct 130 to receive an airflow. One or both of the outer walls 74, 76 define a separate outlet 80. Optionally, outer walls 74, 76 may collectively define an exhaust outlet 80 directly above burner tube 68. As shown, outlet 80 may be defined between broiler passage 132 and bake passage 136. Circulation passage 134 may extend alongside the combustion enclosure below outlet 80. During operations involving heating element 50, inlet 78 may generally permit air into burner enclosure 72 while outlet 80 directs a flame exhaust out of burner enclosure 72, e.g., as a heated gas.

Burner enclosure 72 may include a plurality of inner walls 82, 84, such as a first inner wall 82 and an oppositely-disposed second inner wall 84. Inner walls 82, 84 may be spaced apart, e.g., in the transverse direction T. Moreover, inner walls 82, 84 may be bounded by outer walls 74, 76 within burner enclosure 72. Optionally, inner walls 82, 84 may form a flame hood disposed over burner tube 68. During use, a flame generated at burner tube 68 may extend into, and be contained within, flame hood formed by inner walls 82, 84. In turn, inner walls 82, 84 may at least partially isolate the flame from the outer walls 74, 76, e.g., such that the flame does not contact inner walls 82, 84.

An exhaust path 86 may be defined between the oppositely-disposed inner walls 82, 84. For instance, exhaust path 86 may extend between burner tube 68 and outlet 80 of burner enclosure 72. In some such embodiments, inner walls 82, 84 are spaced apart from outer walls 74, 76, e.g., in the transverse direction T. One or more air chambers 88, 90 may be defined between an inner wall 82, 84 and an outer wall 74, 76 of burner enclosure 72. One air chamber 88 may extend in the transverse direction T toward the cooking chamber 14 between first inner wall 82 and an outer wall 74 of burner enclosure 72. Another air chamber 90 may extend in the transverse direction T away from the cooking chamber 14 between second inner wall 84 and another outer wall 76 of burner enclosure 72.

In some embodiments, inlet 78 includes a plurality of openings 92, 94 extending through an outer wall 76 of burner enclosure 72, e.g., in the transverse direction T. Optionally, multiple discrete sets of openings may be provided. For instance, a primary set of openings 92 may extend through outer wall 76 of burner enclosure 72. As illustrated, primary openings 92 may extend through outer wall 76 below inner walls 82, 84, e.g., in the vertical direction V. In some such embodiments, primary openings 92 are defined below burner tube 68. Each of the primary openings 92 may be substantially parallel. Additionally or alternatively, each of the primary openings 92 may be defined along a sequence such that the primary openings 92 are arranged side-by-side in the lateral direction L (See FIG. 4).

A secondary set of openings 94 may further extend through outer wall 76 of burner enclosure 72. As illustrated, secondary openings 94 may extend through outer wall 76 above burner tube 68, e.g., in the vertical direction V. In some such embodiments, secondary openings 94 extend into an air chamber 88, 90. Each of the secondary openings 94 may be substantially parallel. Additionally or alternatively, each of the secondary openings 94 may be defined along a sequence such that the primary openings 92 are arranged side-by-side in the lateral direction L (See FIG. 4).

Optionally, one or more ports 96 may be defined in fluid communication with inlet 78. As illustrated, ports 96 may be extend from an air chamber 88, 90 to outlet 80. Moreover, ports 96 may be defined above secondary openings 94, e.g., proximate to outlet 80. For instance, ports 96 may be defined through an angled top portion of inner wall 82, 84. During operations, air may be directed through air chamber 88, 90 (e.g., from secondary openings 94) and out of ports 96.

An isolated air supply duct 110 is provided in some embodiments. As shown, air supply duct 110 defines a passage 112 that extends between two ends 114, 116. When assembled, passage 112 may be in fluid communication with burner enclosure 72. An inlet 118 of air supply duct 110 may be defined at one end 114 while an outlet 120 is defined at the opposite end 116. Optionally, air supply duct 110 may be partially or fully housed within cabinet 12. In some such embodiments, inlet 118 is defined in communication with the ambient environment, e.g., at a bottom portion of cabinet 12. Outlet 120 of air supply duct 110 may be defined adjacent to the inlet 78 of burner enclosure 72, e.g., in direct engagement with burner enclosure 72. Air for combustion may thus enter air supply duct 110 at inlet 118 before passing through passage 112 to outlet 120. Air passing from outlet 120 may then enter burner enclosure 72 at inlet 78, e.g., through primary opening(s) 92 and/or secondary opening(s) 94.

In some embodiments one or more combustion air handlers 48, such as a burner fan, is disposed upstream from heating element 50, e.g., upstream from a gas burner. Specifically, combustion air handler 48 may be in upstream fluid communication with inlet 78 of burner enclosure 72. Isolated air supply duct 110 disposed in fluid communication between the air handler 48 and inlet 78 of heating element 50. Optionally, combustion air handler 48 may be disposed within passage 112 of air supply duct 110. During operations, combustion air handler 48 may motivate air into inlet 78, e.g., to facilitate combustion within burner enclosure 72 and/or force heat exhaust from burner enclosure 72.

One or more convection air handlers 46, such as a circulation fan, are disposed in fluid communication with convection duct 130. Through convection duct 130, convection air handler 46 may be in fluid communication with outlet 80 of burner enclosure 72. Convection air handler 46 may be operable to direct a heated gas through convection duct 130 according to one or more operations. During certain operations, air may be recirculated from one portion of cooking chamber 14 to another portion. For instance, convection air handler 46 may motivate air through broiler passage 132 and to or from broiler plate 52, as will be described below. In some embodiments, convection air handler 46 is disposed within convection duct 130, e.g., mounted at the circulation passage 134. Moreover, convection air handler 46 may be positioned below heating element 50 along the vertical direction V.

Figure 4:
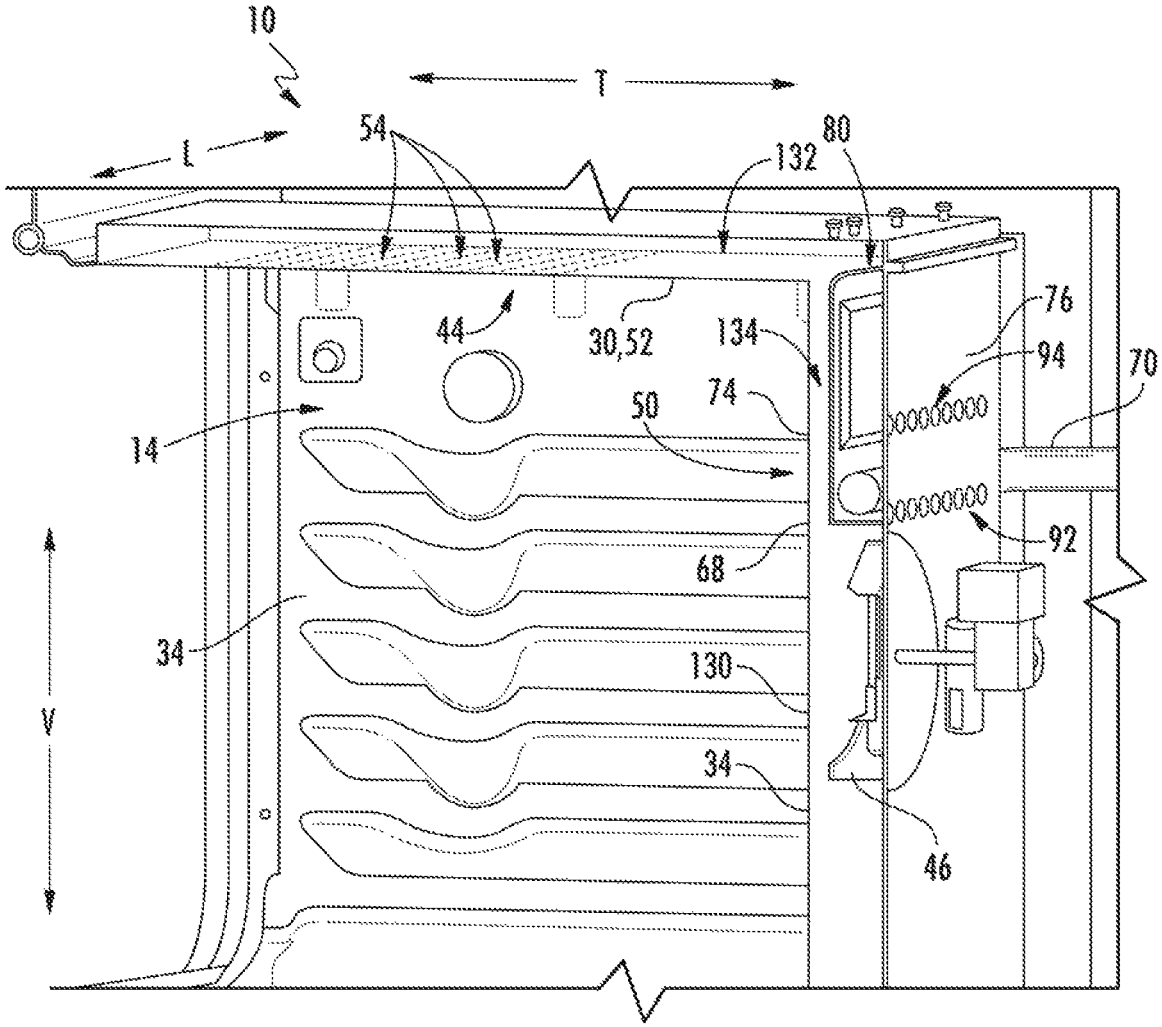
FIG. 4 provides a sectional perspective view of a rear portion of an oven appliance according to example embodiments of present disclosure.

Turning now to FIG. 4, broiler plate 52 is positioned at a top portion of the cooking chamber 14 in fluid communication with convection duct 130. Broiler plate 52 may be a substantially planar member extending, e.g., perpendicular to the vertical direction V, along a portion cooking chamber 14. In some embodiments, broiler plate 52 defines at least a portion of top wall 30. Advantageously, broiler plate 52 may thus avoid encroaching into cooking chamber 14 and reducing the volume thereof. In example embodiments, broiler plate 52 extends from one opposing sidewall 34 to the other opposing sidewall 36 (FIG. 1) along the lateral direction L, as illustrated in FIG. 4. In additional or alternative embodiments, broiler plate 52 extends from the rear wall 38 to the opening of cooking chamber 14. Optionally, the broiler plate 52 may form the entire top wall 30.

One or more apertures 54 are defined through broiler plate 52, e.g., as slots or holes, to direct a heated gas to the cooking chamber 14. Apertures 54 may be in fluid communication between convection duct 130 and cooking chamber 14. For instance, the apertures 54 may extend, e.g., in the vertical direction V, through broiler plate 52 from the broiler passage 132 to cooking chamber 14.

Figure 5:
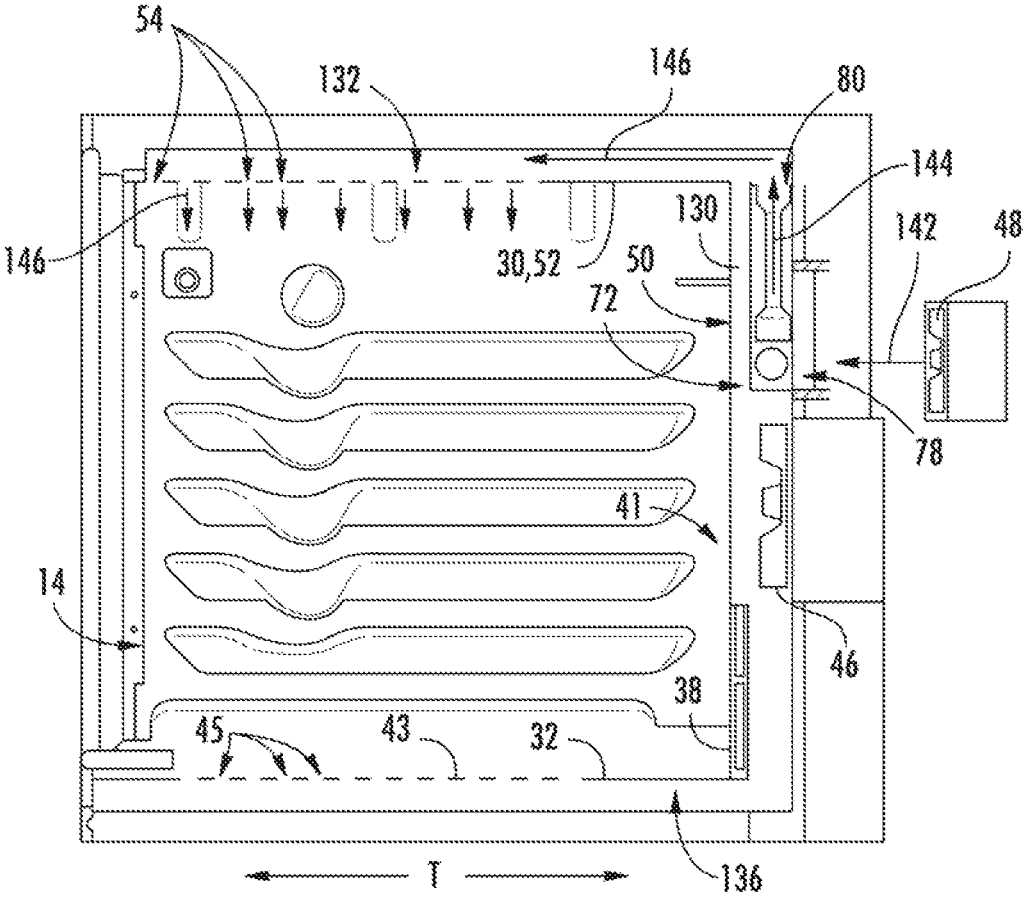
FIG. 5 provides a sectional view of portion of an oven appliance according to example embodiments of present disclosure during a broiler operation.
Figure 6:
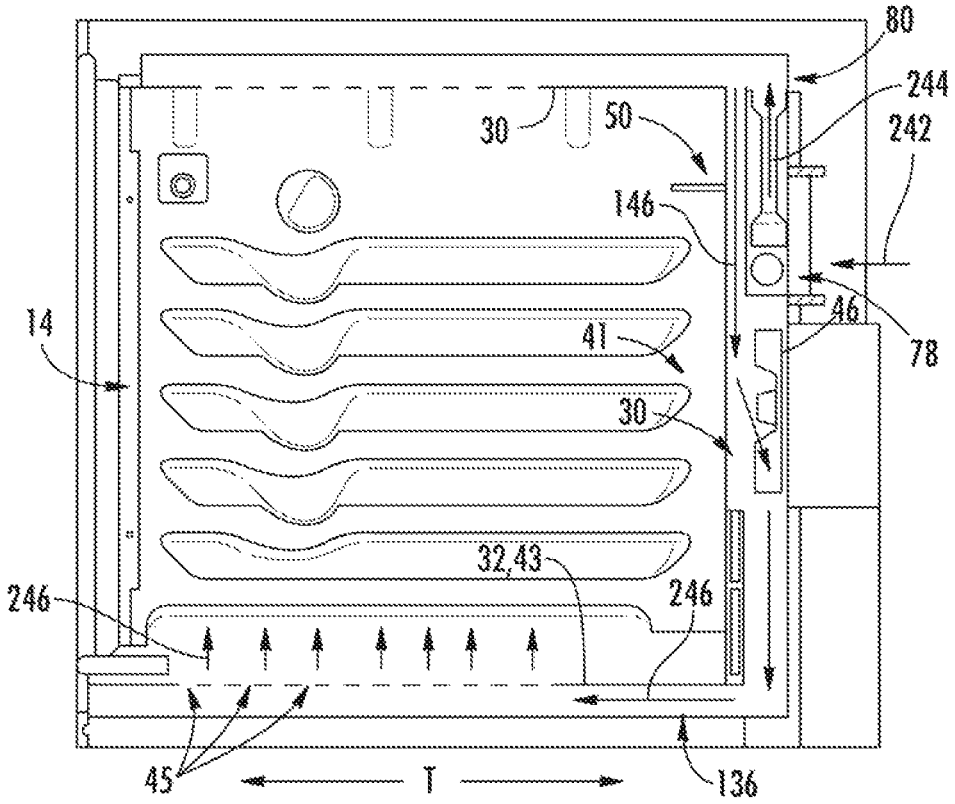
FIG. 6 provides a sectional view of portion of an oven appliance according to example embodiments of present disclosure during a baking operation.

It is understood that bake plate 43 may optionally mirror the structure of broiler plate 52 along a bottom portion of the cooking chamber 14. As illustrated in FIGS. 2, 5, and 6, bake plate 43 may be positioned at a bottom portion of the cooking chamber 14 in fluid communication with convection duct 130. Bake plate 43 may be a substantially planar member extending, e.g., perpendicular to the vertical direction V, along a portion cooking chamber 14. In some embodiments, bake plate 43 defines at least a portion of bottom wall 32. Advantageously, bake plate 43 may thus avoid encroaching into cooking chamber 14 and reducing the volume thereof. In example embodiments, bake plate 43 extends from one opposing sidewall 34 to the other opposing sidewall 36 (FIG. 1) along the lateral direction L. In additional or alternative embodiments, bake plate 43 extends from the rear wall 38 to the opening of cooking chamber 14. Optionally, the bake plate 43 may form the entire bottom wall 32.

One or more apertures 45 are defined through bake plate 43, e.g., as slots or holes, to direct a heated gas to the cooking chamber 14. Apertures 45 may be in fluid communication between convection duct 130 and cooking chamber 14. For instance, the apertures 45 may extend, e.g., in the vertical direction V, through bake plate 43 from the bake passage 136 to cooking chamber 14.

As illustrated in FIGS. 5 and 6, appliance is operable to motivate a heated gas into cooking chamber 14, e.g., in order to heat or cook food items positioned below broiler plate 52. One or more modes, such as a discrete broiler operation (FIG. 5) and a discrete baking operation (FIG. 6), may be provided. Controller 40 (FIG. 1) may alternately initiate the broiler mode and the bake mode in response to one or more user inputs, e.g., provided through controls 64 (FIG. 1). Heating element 50 may remain active for both baking and broiling operations. Advantageously, appliance 10 may rapidly alternate between such baking and broiling operations without waiting for another heating element to be activated and/or deactivated.

Turning now to FIG. 5, during example broiler operations, an initial airflow (indicated at arrow 142) may be provided to heating element 50. For instance, an initial air volume may be motivated through inlet 78 into burner enclosure 72 by air handler 48. The initial airflow 142 may be provided from the ambient environment, e.g., through inlet 118 of air supply duct 110 (FIG. 2). Air within burner enclosure 72 may then mix with fuel supplied through burner tube 68. The mixture of initial airflow 142 and fuel may be ignited to generate a flame exhaust (indicated at arrow 144). Combustion and backpressure generated at combustion air handler 48 may motivate exhaust 144 through outlet 80 into convection duct 130 as a heated gas (indicated at arrows 146) for convection. Optionally, additional air, such as that provided through secondary openings 94 (FIG. 3), may be mixed with exhaust 144, e.g., at outlet 80, to further form heated gas 146. Additionally or alternatively, air from cooking chamber 14 may also be recirculated. For instance, air may be drawn through the apertures 45 into bake passage 136. Air from cooking chamber 14 may be then mixed with exhaust 144 within convection duct 130 to further form heated gas 146.

Heated gas 146 may be guided through broiler passage 132 of convection duct 130 and to broiler plate 52. For instance, exhaust 144 and/or heated gas 146 may be directed exclusively to broiler plate 52, e.g., as a solely convective heat source for the top portion of cooking chamber 14. At the broiler plate 52, heated gas 146 may be guided through the apertures 54 and into cooking chamber 14. Advantageously, the heated gas 146 may directly heat any items, e.g., food items, positioned beneath broiler plate 52. Moreover, heat may be received immediately from the heated gas 146. The size and spacing of the apertures 54 may control the distribution of heated gas 146, providing the desired heat to cooking chamber 14 and/or items therein.

Turning now to FIG. 6, during example baking operations, an initial airflow (indicated at arrow 242) may be provided to heating element 50. For instance, an initial air volume may be motivated through inlet 78 into burner enclosure 72 by air handler 46. For instance, the pressure generated by air handler 46 within circulation passage 134 may draw air into burner enclosure 72. The initial airflow 242 may be provided from the ambient environment, e.g., through inlet 118 of air supply duct 110 (FIG. 2). Air within burner enclosure 72 may then mix with fuel supplied through burner tube 68.

The mixture of initial airflow 242 and fuel may be ignited to generate a flame exhaust (indicated at arrow 244). Combustion and pressure generated at combustion air handler 46 may motivate exhaust 244 through outlet 80 into convection duct 130 as a heated gas (indicated at arrows 246) for convection. Optionally, additional air, such as that provided through secondary openings 94 (FIG. 3), may be mixed with exhaust 244, e.g., at outlet 80, to further form heated gas 246. Additionally or alternatively, air from cooking chamber 14 may also be recirculated. For instance, air may be drawn through the apertures 54 into broiler passage 132. Air from cooking chamber 14 may be then mixed with exhaust 244 within convection duct 130 to further form heated gas 246.

Heated gas 246 may be guided through bake passage 136 of convection duct 130 and to bake plate 43. For instance, exhaust 244 and/or heated gas 246 may be directed exclusively to bake plate 43, e.g., as a solely convective heat source for the bottom portion of cooking chamber 14. At the bake plate 43, heated gas 246 may be guided through the apertures 45 and into cooking chamber 14. Advantageously, the heated gas 246 may directly heat any items, e.g., food items, positioned beneath broiler plate 52. Moreover, heat may be received immediately from the heated gas 246. The size and spacing of the apertures 45 may control the distribution of heated gas 246, providing the desired heat to cooking chamber 14 and/or items therein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. Oven appliance comprising:

a cabinet defining a cooking chamber to receive items to be cooked, the cabinet comprising a top wall, a bottom wall, a rear wall, and opposing sidewalls, the top wall and the bottom wall being spaced apart along a vertical direction, the opposing sidewalls being spaced apart along a lateral direction;

a convection duct extending about a portion of the cooking chamber to direct a heated gas, the convection duct defining an upper passage above the top wall, a lower passage below the bottom wall, and a circulation passage extending from the upper passage to the lower passage;

a heating element disposed within the convection duct to supply the heated gas thereto; and an air handler disposed in fluid communication with the convection duct to motivate the heated gas therethrough, wherein the heating element comprises a burner tube and a burner enclosure housing the burner tube rearward from the rear wall within the circulation passage, the burner enclosure defining an exhaust outlet between the upper passage and the lower passage to direct to an exhaust of a flame of the burner tube as the heated gas, and wherein the air handler is positioned beneath the burner enclosure to selectively direct the heated gas to the upper passage and the lower passage.

2. The oven appliance of claim 1, wherein the burner enclosure further defines an inlet extending from the convection duct to receive an airflow.

3. The oven appliance of claim 2, wherein the air handler is a first air handler, and wherein the oven appliance further comprises a second air handler in upstream fluid communication with the inlet of the burner enclosure.

4. The oven appliance of claim 3, further comprising an isolated air supply duct disposed in fluid communication between the second air handler and the inlet of the gas burner.

5. The oven appliance of claim 1, further comprising:

a broiler plate positioned at a top portion of the cooking chamber, the top distributor plate defining a plurality of apertures in fluid communication with the upper passage; and a bake plate positioned at a bottom portion of the cooking chamber, the bake plate defining a plurality of apertures in fluid communication with the lower passage.

6. The oven appliance of claim 5, further comprising a controller operably connected to the air handler and configured to initiate discrete broiling and baking operations, the broiling operation including motivating the heated gas from the upper passage to the apertures of the broiler plate, the baking operation including motivating the heated gas from the lower passage to the apertures of the baking plate.

7. The oven appliance of claim 1, wherein the heating element is a solitary heating element for the cooking chamber.

8. Oven appliance comprising:

a cabinet defining a cooking chamber to receive items to be cooked, the cabinet comprising a top wall, a bottom wall, a rear wall, and opposing sidewalls, the top wall and the bottom wall being spaced apart along a vertical direction, the opposing sidewalls being spaced apart along a lateral direction;

a convection duct extending about a portion of the cooking chamber to direct a heated gas, the convection duct defining an upper passage above the top wall, a lower passage below the bottom wall, and a circulation passage extending from the upper passage to the lower passage;

a broiler plate positioned at a top portion of the cooking chamber, the broiler plate defining a plurality of apertures in fluid communication with the upper passage;

a bake plate positioned at a bottom portion of the cooking chamber, the bake plate defining a plurality of apertures in fluid communication with the lower passage;

a heating element disposed outside of the cooking chamber within the convection duct to alternately supply the heated gas to the upper passage and the lower passage; and an air handler disposed within the convection duct to motivate the heated gas therethrough, wherein the heating element comprises a burner tube and a burner enclosure housing the burner tube rearward from the rear wall within the circulation passage, the burner enclosure defining an exhaust outlet between the upper passage and the lower passage to direct to an exhaust of a flame of the burner tube as the heated gas, and wherein the air handler is positioned beneath the burner enclosure to selectively direct the heated gas to the upper passage and the lower passage.

9. The oven appliance of claim 8, wherein the burner enclosure further defines an inlet extending from the convection duct to receive an airflow.

10. The oven appliance of claim 9, wherein the air handler is a first air handler, and wherein the oven appliance further comprises a second air handler in upstream fluid communication with the inlet of the burner enclosure.

11. The oven appliance of claim 8, further comprising a controller operably connected to the air handler and configured to initiate discrete broiling and baking operations, the broiling operation including motivating the heated gas from the upper passage to the apertures of the broiler plate, the baking operation including motivating the heated gas from the lower passage to the apertures of the bake plate.

12. The oven appliance of claim 8, wherein the heating element is a solitary heating element for the cooking chamber.

* * * * *